358-74 SR

3/24/87 XR 4,652,869

United States Patent [19]

Vakil

[11] Patent Number: 4,652,869

[45] Date of Patent: Mar. 24, 1987

[54] COLOR ENHANCEMENT FOR DISPLAY DEVICE

[75] Inventor: Bharat N. Vakil, Coral Springs, Fla.

[73] Assignee: Allied Corporation, Morristown, N.J.

[21] Appl. No.: 723,676

[22] Filed: Apr. 16, 1985

[51] Int. Cl.[4] ..... G09G 1/28

[52] U.S. Cl. ..... 340/703; 340/701; 358/74

[58] Field of Search ..... 340/701, 703, 715, 720, 340/815.1; 358/74

[56] References Cited

U.S. PATENT DOCUMENTS

| | | | |
|---|---|---|---|
| 4,467,322 | 8/1984 | Bell et al. | 340/703 |
| 4,599,643 | 7/1986 | Harlan | 358/74 |
| 4,604,647 | 8/1986 | Pecle | 358/74 |

FOREIGN PATENT DOCUMENTS

| | | | |
|---|---|---|---|
| 52-27317 | 3/1977 | Japan | 340/703 |
| 55-20517 | 2/1980 | Japan | 340/703 |

*Primary Examiner*—Gerald L. Brigance

*Attorney, Agent, or Firm*—Robert M. Trepp; Bruce L. Lamb

[57] ABSTRACT

A circuit for modifying the luminescence of one color of a multicolor display device is described incorporating a logic circuit, a plurality of amplifiers, a plurality of multipliers, and a display device for displaying a plurality of colors. The invention overcomes the problem of insufficient luminescence of certain colors on the screen of a display device.

7 Claims, 1 Drawing Figure

COLOR ENHANCEMENT FOR DISPLAY DEVICE

BACKGROUND OF THE INVENTION

1. Field of the Invention

This invention relates to circuitry for a color display device and more particularly to circuitry for modifying the luminescence of one color with respect to other colors on a multicolor display device.

2. Description of the Prior Art

In electronic flight instrument systems (EFIS) certain mechanical instruments have been replaced electronically by displaying the image of the mechanical instrument on a display device. One example of a mechanical instrument that has been replaced by an image on a display device is an attitude direction indicator (ADI) which shows the attitude of an aircraft by displaying various symbols, lettering, lines and background in various colors. Another example of a mechanical instrument which has been replaced by displaying an image on a display device is a horizontal situation indicator (HSI) which also displays a number of symbols, a compass rose, lettering, lines and boxes enclosing lettering in various colors. For example, in the horizontal situation indicator display the following colors are observed, red, magenta, white, green, yellow, and orange. Colors that may be seen in the attitude direction indicator are red, green, orange, yellow and white. In addition, a dark blue background is shown in the upper half of the display and a brown background is shown in the lower half of the display. During flight of an aircraft, ambient lighting, impinging light, etc. may make it extremely difficult to clearly observe the display including certain flags, for example, the lettering "auto test failed". Flags may be placed on the display over symbols in various colors formed during the stroke mode of the display device or over a background formed during the raster mode of the display device. In the stroke mode, the display device paints out a symbol directly. In the raster mode, the display device paints in a raster pattern, such as from left to right, across the display device with each new sweep indexed vertically.

It is therefore desirable to increase the luminescence of the colors used to provide warning flags on the display device.

It is further desirable to provide an increase in the luminescence of the color red during the formation of certain warning flags on the display device.

It is further desirable to increase the luminescence of certain colors on the display device relative to other colors to provide sufficient luminescence for observation by the naked eye.

SUMMARY OF THE INVENTION

An apparatus for modifying the luminescence of one color of a multicolor display device is described comprising a logic circuit having first and second inputs and an output, a first amplifier adapted for receiving a first input signal for controlling a first color and having an output signal coupled to a first input of a first multiplier and to said first input of said logic circuit, a second amplifier adapted for receiving a second input signal for controlling a second color and having an output signal coupled to a first input of a second multiplier and to said second input of said logic circuit, a third amplifier adapted for receiving a third input signal for controlling a third color and having an output signal coupled through a first resistive impedance to a first input of a third multiplier in common with a second resistive impedance coupled to said output of said logic circuit, a fourth input signal indicative of brightness coupled to a second input of said first through third multipliers, the output of said first through third multipliers coupled to respective color inputs of said display device, whereby the output of said logic circuit will modify the amplitude of said third input signal at said first input to said third multiplier, thereby modifying the luminescence of said third color on said display device.

DESCRIPTION OF THE PREFERRED EMBODIMENT

Figure 1:
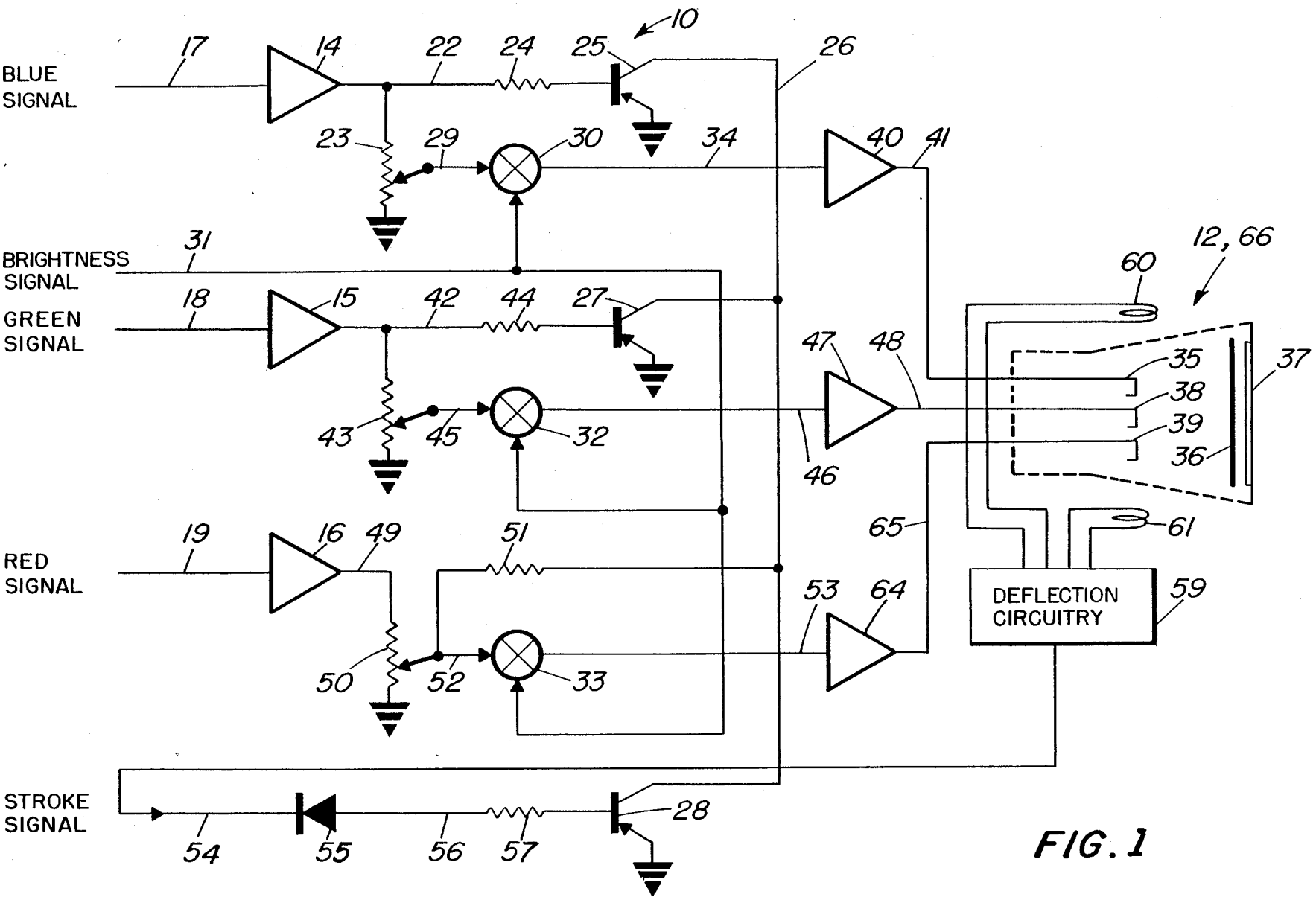
FIG. 1 shows one embodiment of the invention.

Referring to FIG. 1, a circuit 10 is shown for modifying the luminescence of one color of a multicolor display device 12. Amplifiers 14, 15 and 16 have an input such as leads 17–19, respectively, for controlling the presence of a color on display device 12, for example blue, green and red, respectively. The output of amplifier 14 is coupled over line 22 through potentiometer 23 to ground potential and through resistor 24 to the base of transistor 25. Transistor 25 may be, for example, a PNP transistor having its emitter coupled to ground potential and its collector coupled over line 26 to the collector of transistors 27 and 28. The tap of potentiometer 23 is coupled over line 29 to a first input of multiplier 30. A brightness signal is coupled over line 31 to a second input of multiplier 30, as well as to a second input of multipliers 32 and 33. The output of multiplier 30 is coupled over line 34 through amplifier 40 over line 41 to cathode 35 of display device 12 which may be, for example, a cathode ray tube 66 having a shadow mask 36 and a screen 37 having phosphors at each pixel location for displaying blue, green and red colors in response to an electron beam from cathodes 35, 38 and 39.

The output of amplifier 15 is coupled over line 42 through potentiometer 43 to ground potential and through resistor 44 to the base of transistor 27. The tap of potentiometer 43 is coupled over line 45 to a first input of multiplier 32. The output of multiplier 32 is coupled over line 46 through amplifier 47 over line 48 to cathode 38 of display device 12. The output of amplifier 16 is coupled over lead 49 through potentiometer 50 to ground potential. The tap of potentiometer 50 is coupled over lead 52 through resistor 51 over lead 26 to the collectors of transistors 25, 27 and 28. The tap of potentiometer 50 is also coupled over lead 52 to the first input of multiplier 33, having an output coupled over lead 53 through amplifier 64 over line 65 to cathode 39 of display device 12. A stroke signal from deflection circuitry 59 is coupled over lead 54 to the cathode of diode 55. The anode of diode 55 is coupled over lead 56 through resistor 57 to the base of transistor 28. Transistors 27 and 28, as well as transistor 25, may be bipolar PNP transistors having its emitter coupled to ground.

In operation, the blue signal, green signal, and red signal on lines 17–19, respectively, are logic signals having a one or zero. When the logic signal is one, such as on line 17, the output of amplifier 14 is −0.6 V, causing transistor 25 to conduct and providing an input signal through potentiometer 23 to multiplier 30. When the blue signal is a logic zero, the output of amplifier 14 is OV, causing transistor 25 to be non-conducting. Potentiometers 23, 43 and 50 provide for video gain adjustment of the blue, green and red signals, respectively. A brightness control signal on line 31 which may be, for example, an analog voltage, provides a signal to multipliers 30, 32 and 33 which is multiplied by the signals on lines 29, 45 and 52, respectively to provide an output on lines 34, 46 and 53, respectively, having an amplitude controlled by the signal on line 31. The signals on lines 34, 46 and 53 are amplified by amplifiers 40, 47 and 64, respectively, and coupled to cathodes 35, 38 and 39 of display device 12. The amplitude of the signal controls the resulting luminescence of the color on screen 37. Display device 12 may be operated at a 72 Hz frame rate providing a time interval of 14 msec per frame. During each 14 msec frame, 4 msec is allocated to the raster mode and 10 msec is allocated to the stroke mode. During the raster mode a raster is painted on screen 37, for example, by one or more cathodes 35, 38 and 39. During the stroke mode, one or more cathodes 35, 38 and 39 provide a beam which may be deflected or steered to paint or draw symbols on screen 37. The electron beam at each pixel point may illuminate three different colors corresponding to the three cathodes 35, 38 and 39, which is well known in the art. Deflection circuitry 59 is coupled to deflection coils 60 and 61 for steering the electron beam in both the raster and stroke mode.

During the stroke mode, red flags, such as lettering in the form of words, are written on screen 37. To enhance the luminescence or brightness of the color red, so as to stand out above the other colors on the screen, the amplitude of the red signal on line 53 is increased. At times the red signal is written during the stroke mode, the logic circuit comprising transistors 25, 27 and 28 will be non-conducting, causing resistor 51 to float, allowing the voltage on line 52 to increase, for example, by 20%. Due to the gamma of cathode ray tube 66, the resultant red luminous enhancement is 30%. Resistor 51 may be, for example, 580 ohms and potentiometer 50 may be, for example, a 500 ohm potentiometer. At other times, when a red flag is not being written, the presence of the blue signal or green signal will cause resistor 51 to be coupled to ground potential through line 26 and the conducting transistor. Also, when display device 12 is operating in the raster mode, the stroke signal will be −7 V in place of +7 V during the stroke mode, causing transistor 28 to be conducting, causing resistor 51 to be coupled to ground potential.

The invention provides an apparatus for modifying the luminescence of one color of a multicolor display device, comprising: a logic circuit having first and second inputs and an output, a first amplifier adapted for receiving a first input signal for controlling a first color and having an output signal coupled to a first input of a first multiplier and to said first input of said logic circuit, a second amplifier adapted for receiving a second input signal for controlling a second color and having an output signal coupled to a first input of a second multiplier and to said second input of the logic circuit, a third amplifier adapted for receiving a third input signal for controlling a third color and having an output signal coupled through a first resistive impedance to a first input of a third multiplier, in common with a second resistive impedance coupled to said output of the logic circuit, a fourth input signal indicative of brightness coupled to a second input of said first through third multipliers, the output of said first through third multipliers coupled to respective color inputs of said display device, whereby the output of said logic circuit will modify the amplitude of the signal at said first input to said third multiplier, thereby modifying the luminescence of said third color on said display device.

The invention claimed is:

1. Apparatus for modifying the luminescence of one color of a multicolor display device having a plurality of color inputs comprising:

a logic circuit having first and second inputs and an output, a first amplifier having an input for receiving a first input signal for controlling a first color and having an output coupled to a first input of a first multiplier and to said first input of said logic circuit, a second amplifier having an input for receiving a second input signal for controlling a second color and having an output coupled to a first input of a second multiplier and to said second input of said logic circuit, a third amplifier having an input for receiving a third input signal for controlling a third color and having an output coupled through a first resistive impedance to a first input of a third multiplier, in common with a second resistive impedance coupled to said output of said logic circuit, a fourth input for receiving a fourth input signal indicative of brightness coupled to a second input of said first through third multipliers, the output of said first through third multipliers coupled to said plurality of color inputs respectively of said display device, the output of said logic circuit functioning to provide a first impedance at times said output of said first and second amplifiers are low and a second impedance at times one of said outputs of said first and second amplifiers is high to modify the amplitude of the signal at said first input of said third multiplier, whereby the output of said third multiplier and the luminescence of said third color on said display device is modified.

2. The apparatus of claim 1 further including a fifth input for receiving a fifth input signal indicative of a stroke function of said display device coupled to a third input of said logic circuit.

3. The apparatus of claim 1 further including a potentiometer coupled between said output of said first amplifier and said first input of said first multiplier.

4. The apparatus of claim 3 further including a second potentiometer coupled between said output of said second amplifier and said first input of said second multiplier.

5. The apparatus of claim 4 further including a third potentiometer coupled between said output of said third amplifier and said first input of said third multiplier.

6. The apparatus of claim 1 wherein said logic circuit includes first and second transistors having an emitter, base and collector, first and second resistors coupled to the base of said first and second transistors respectively, the emitter of said first and second transistors coupled to ground potential and the collector of said first and second transistors coupled to said output of said logic circuit.

7. The apparatus of claim 1 wherein said display device includes a cathode ray tube having three cathodes for displaying three colors respectively on a screen.

* * * * *